United States Patent [19]

Yamamoto et al.

[11] 4,002,149

[45] Jan. 11, 1977

[54] ARRANGEMENT OF HEAT TRANSFER TUBES IN A HEATING FURNACE

[75] Inventors: Etsuji Yamamoto, Tokyo; Noriaki Nakase, Osaka, both of Japan

[73] Assignees: Mitsui Shipbuilding and Engineering Co. Ltd.; Mitsui Petrochemical Industries Limited, both of Tokyo, Japan

[22] Filed: Aug. 28, 1975

[21] Appl. No.: 608,622

[30] Foreign Application Priority Data

Sept. 4, 1974 Japan ..... 49-101658
June 24, 1975 Japan ..... 50-78156

[52] U.S. Cl. ..... 122/356; 122/283
[51] Int. Cl.[2] ..... F22B 21/24
[58] Field of Search ..... 122/355, 356, 333, 283

[56] References Cited

UNITED STATES PATENTS

| | | | |
|---|---|---|---|
| 2,111,380 | 3/1938 | Barnes | 122/356 X |
| 2,229,253 | 1/1941 | Nash et al. | 122/356 X |
| 2,237,502 | 4/1941 | Rickerman | 122/356 X |
| 3,003,481 | 10/1961 | Throckmorton et al. | 122/356 |
| 3,667,429 | 6/1972 | Cross | 122/356 |
| 3,863,607 | 2/1975 | Kreuter | 122/356 |

*Primary Examiner*—Kenneth W. Sprague
*Attorney, Agent, or Firm*—Dorfman, Herrell and Skillman

[57] ABSTRACT

Arrangement of heat transfer tubes in a heating furnace in which the heat transfer tube is divided into several paths in the radiant heat transfer zone and these branched tubes are arranged in juxtaposition and alternative relation in each row and divided into a plurality of groups in a cycle of the alternation, and burners are provided in front of each tube group.

9 Claims, 6 Drawing Figures

ARRANGEMENT OF HEAT TRANSFER TUBES IN A HEATING FURNACE

This invention relates to an arrangement of heat transfer tubes in heating furnaces such as cracking furnaces for producing ethylene.

In the heating furnace comprising one or two heat transfer tube rows, the heat transfer tube is disposed from the inlet header to outlet header in zigzag arrangement and burners are provided on the side wall of the furnace to heat the heat transfer tube. In the case that the heat transfer tube is divided into two rows, tubes are arranged in parallel two rows and burners are disposed on the opposite side walls along the rows of tubes. In this heating furnace, it is difficult to control exactly the temperature of the fluide in every steps of the heating process.

Further, in the case that capacity of product must be increased, a number of heating tube row units must be disposed in the longitudinal direction in the heating furnace. Accordingly, the heating furnace becomes to large scale and complex pipings are required.

The object of the present invention is to provide an arrangement of heat transfer tube which may remove the above drawbacks in the prior art. According to the present invention, heat transfer tube is divided into three to six paths and arranged in two rows in the radiant heat transfer zone, and branched tubes are arranged in juxtaposition and alternative order in each row and divided into groups in a cycle of the alternation, and burners are arranged in front of each tube group.

The present invention will now be described with reference to the accompanying drawings, in which.

Figure 1:
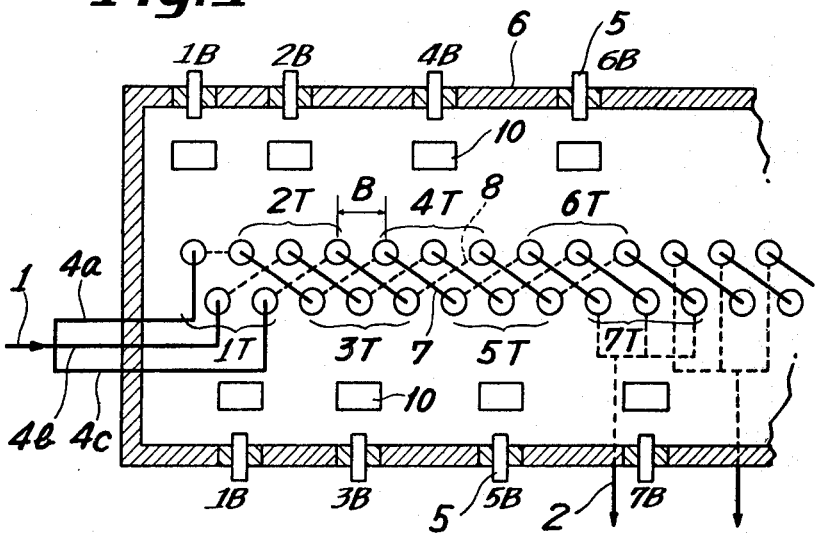
FIG. 1 is a plan view showing an arrangement of heat transfer tubes in a heating furnace according to the present invention.
Figure 2:
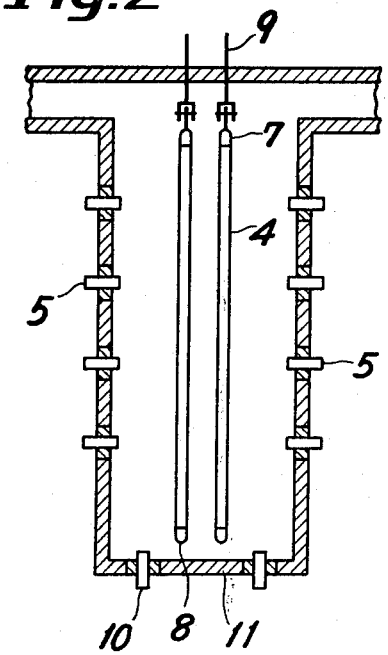
FIG. 2 is a transversal sectional view of the heating furnace of FIG. 1.

Referring to FIG. 1, radiant heat transfer tubes constituting three paths 4*a*, 4*b* and 4*c* are arranged in two rows. The fluid to be heated is supplied from a header 1 to the three radiant heat transfer tubes 4*a*, 4*b* and 4*c* and heated by a number of burners 5 and 10 provided in the side walls 6 and bottom 11 of the furnace. The heated fluid discharged from the outlet header 2 for transfer to the next process. The straight tube portions 4 are connected together by connecting upper return bends 7 and lower return bends 8. Each tube is suspended by hangers 9 as shown in FIG. 2. A number of small capacity burners are arranged for uniformly heating the radiant heat transfer tubes. More particularly, three branched tubes are arranged in the juxtaposition and bent to form two rows so that vertical straight tube portions are disposed in the alternative order. Straight tubes of the individual paths are grouped into a plurality of tube groups 1T, 2T, . . . 7T each consisting of three straight tubes each of which belongs to one of paths. Burners 1B, 2B, . . . 7B are disposed to heat the individual tube groups. With this arrangement of tubes the pitch of arrangement of tubes for each path is larger than that of one path in the prior art. Thus, the individual burner can be arranged in front of the selected tube group. However, the pitch B of the tubes is same as the prior art.

Figure 3:
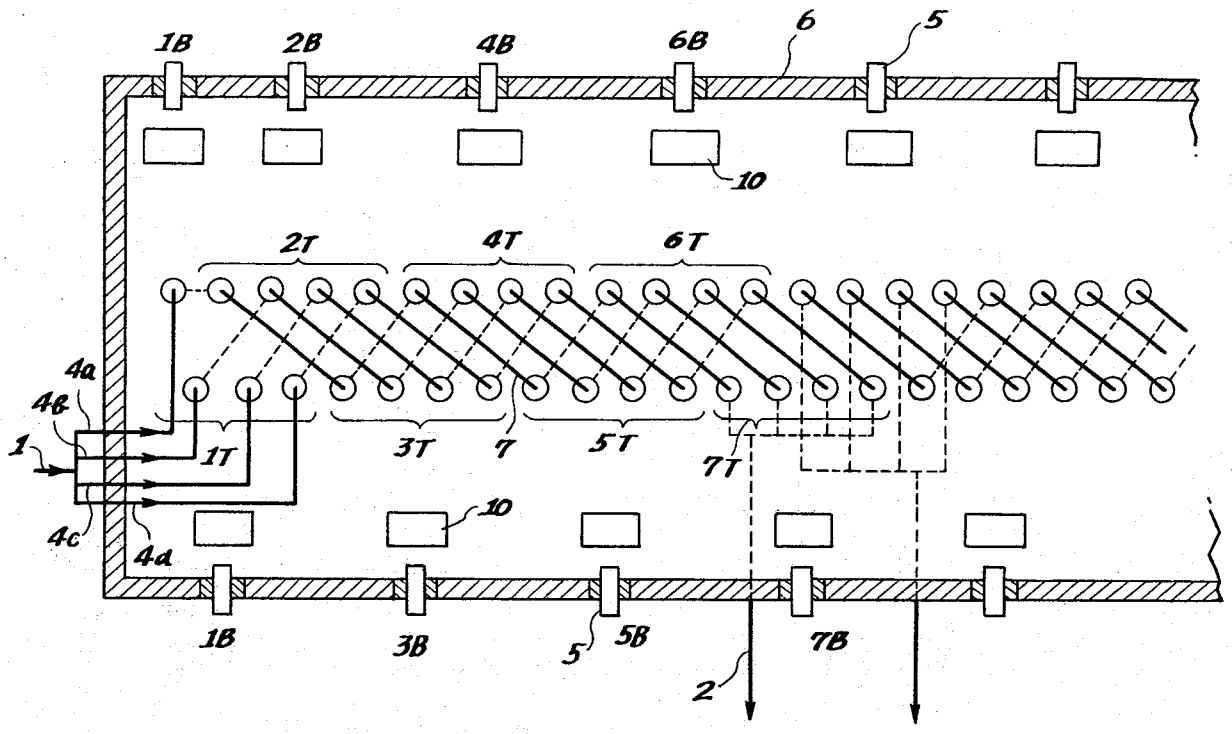
FIGS. 3 to 5 are plan views showing other embodiments of the present invention respectively.

FIG. 3 shows another embodiment comprising four paths. Heat transfer tubes 4*a*, 4*b*, 4*c* and 4*d* are arranged in two rows and divided into groups 1T, 2T, . . . 7T. Burners 1B, 2B, . . . 7B are also disposed in the same manner as above described apparatus illustrated in FIGS. 1 and 2.

Figure 4:
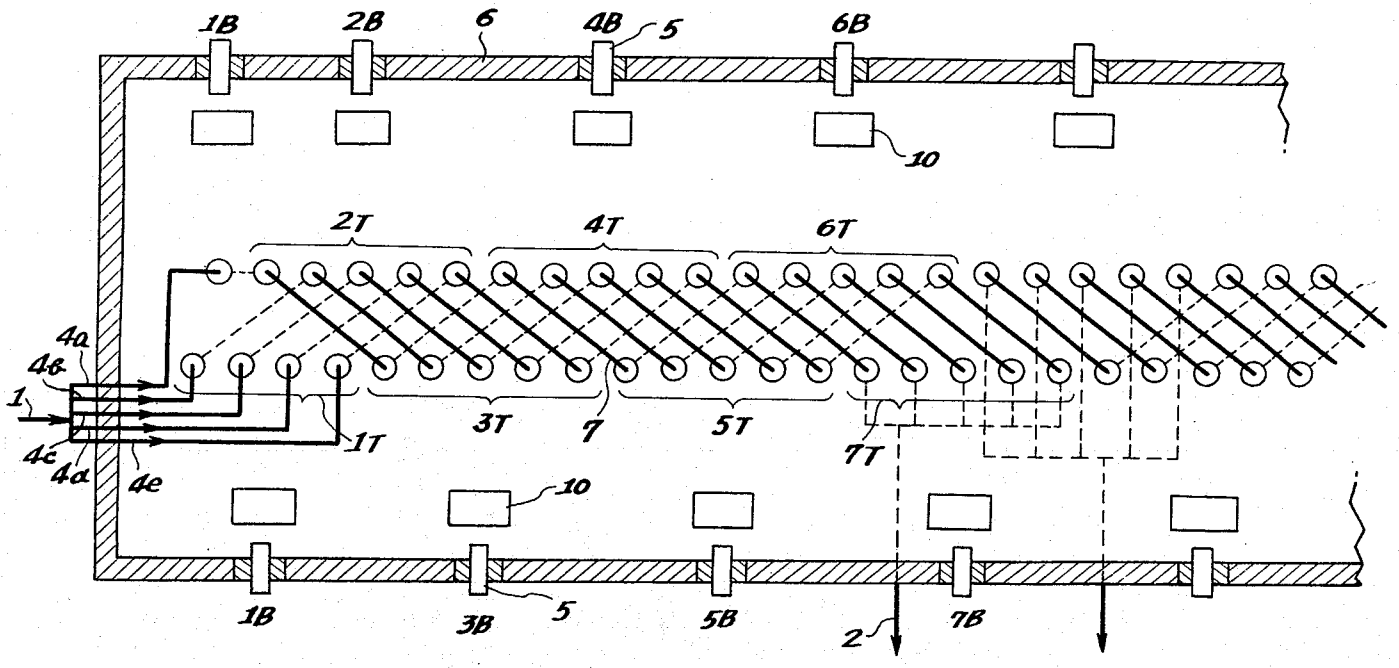
Figure 5:
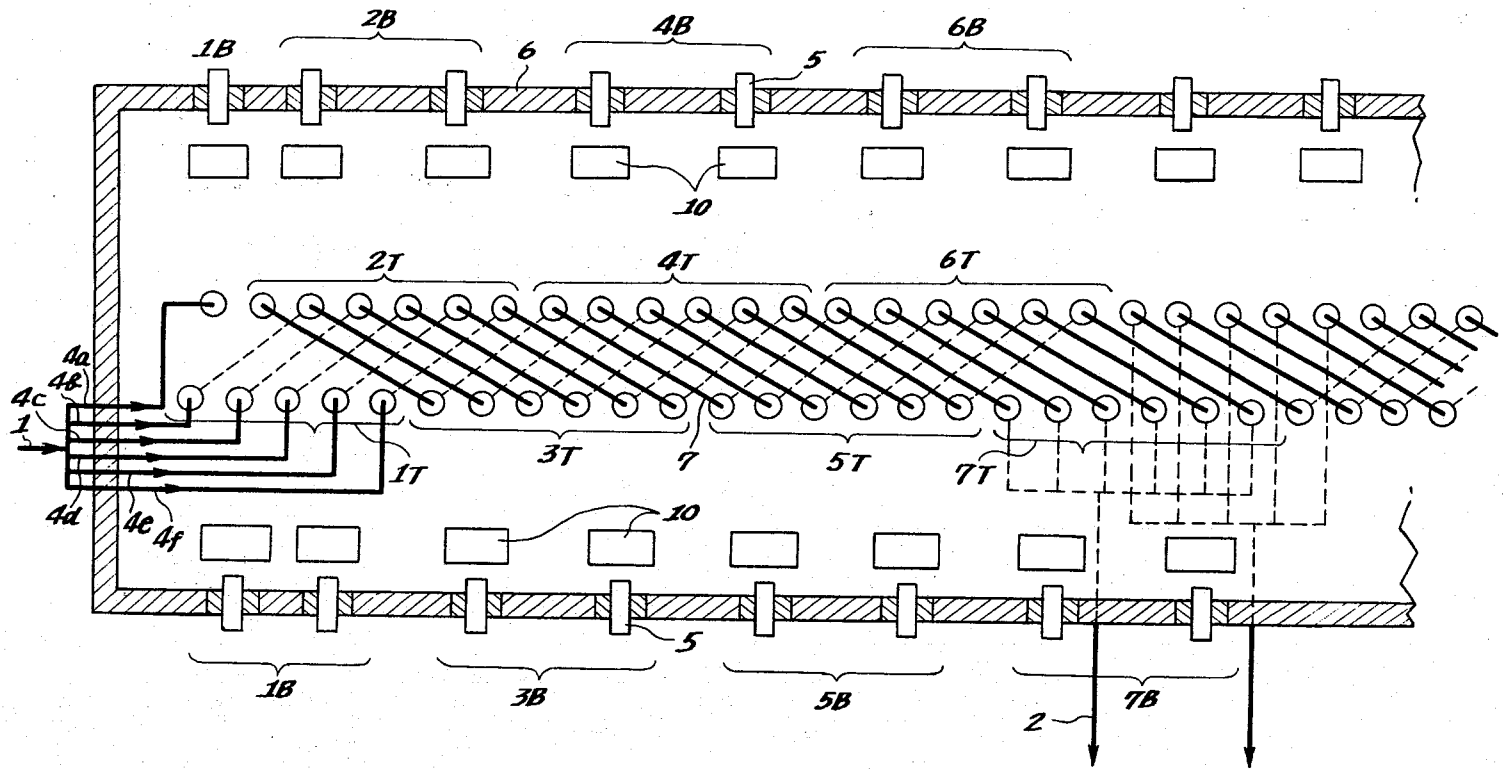

FIG. 4 shows further embodiment of five paths and FIG. 5 shows six paths example. In the drawings same numerals are used for showing same parts.

Figure 6:
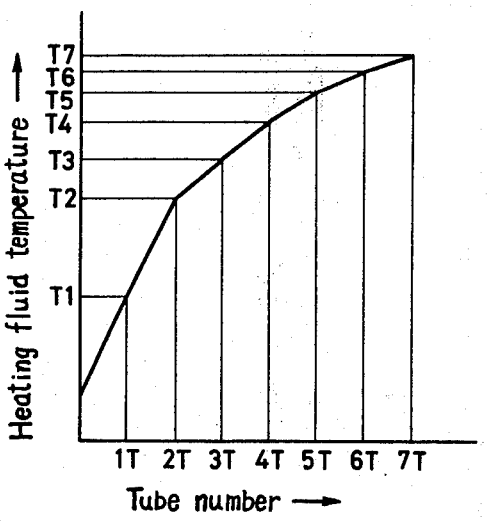
FIG. 6 is a diagram showing an example of temperature distribution over the fluid in the heat transfer tubes between the inlet and outlet of the heating furnace.

With the above combination of the arrangement of heat transfer tubes and arrangement of burners, it is easy to control the heat transfer in the same tube groups, and hence the temperature of the fluid within the individual tubes. FIG. 6 shows an example of the temperature of the fluid within each tube group. In the ethylene cracking furnace, in order to obtain the high yield product such as ethylene and propyrene from the starting material such as propane, butane, naphtha, light oil and kerosene, it is necessary to effect not only the control of temperature at the outlet of the cracking furnace but also the severe control of heat during the heating process. As is apparent from FIG. 6, according to the present invention the control of the heating temperature of the radiant heat transfer tubes during the heating process can be readily performed to obtain effective product in high yield. With the arrangement of the heat transfer tubes in three to six paths branching from the inlet header the processing capacity per heating furnace can be increased to 3 to 1.5 times that in the prior art case comprising a single or two paths with the same tube size, thus permitting the decrease of the number of heating furnaces installed in the plant.

What is claimed is:

1. A heating furnace for fluid material having a plurality of heat-transfer tubes carrying said fluid through the furnace, each tube having a plurality of parallel heat-transfer portions connected together by return bends, said parallel portions being disposed in two rows, the parallel portions of each tube alternating between said rows, the portions in each row being arranged in groups consisting of one heat-transfer portion of each of said tubes, the fluid in all tubes flowing through the same sequence of groups, and a separate burner means confronting each group to thereby separately control the temperature of the fluid in each heat-transfer portion of the several tubes.

2. A furnace according to claim 1 wherein said furnace has three heat-transfer tubes having vertical runs providing said heat-transfer portions, said two rows of vertical runs being disposed in straight parallel alignment, each group consisting of one run of each of said three heat-transfer tubes.

3. A furnace according to claim 2 wherein said burner means comprises a plurality of burners disposed in a vertical line in the side wall of the furnace and an additional burner in the bottom of said furnace, all confronting said group of vertical runs.

4. A furnace according to claim 1 wherein said furnace has four heat-transfer tubes having vertical runs providing said heat-transfer portions, said two rows of vertical runs being disposed in straight parallel alignment, each group consisting of one run of each of said four heat-transfer tubes.

5. A furnace according to claim 4 wherein said burner means comprises a plurality of burners disposed in a vertical line in the side wall of the furnace and an additional burner in the bottom of said furnace, all confronting said group of vertical runs.

6. A furnace according to claim 1 wherein said furnace has five heat-transfer tubes having vertical runs providing said heat-transfer portions, said two rows of vertical runs being disposed in straight parallel alignment, each group consisting of one run of each of said five heat-transfer tubes.

7. A furnace according to claim 6 wherein said burner means comprises a plurality of burners disposed in a vertical line in the side wall of the furnace and an additional burner in the bottom of said furnace, all confronting said group of vertical runs.

8. A furnace according to claim 1 wherein said furnace has six heat-transfer tubes having vertical runs providing said heat-transfer portions, said two rows of vertical runs being disposed in straight parallel alignment, each group consisting of one run of each of said six heat-transfer tubes.

9. A furnace according to claim 8 wherein said burner means comprises a plurality of burners disposed in two vertical lines in the side wall of the furnace and additional burners in the bottom of said furnace, all confronting said group of vertical runs.

* * * * *